US006101770A

United States Patent [19]

Dalton

[11] Patent Number: 6,101,770

[45] Date of Patent: Aug. 15, 2000

[54] THREE-PIECE STAIR NOSING

[75] Inventor: Namen G. Dalton, Wooster, Ohio

[73] Assignee: Wooster Products, Inc., Wooster, Ohio

[21] Appl. No.: 09/170,089

[22] Filed: Oct. 13, 1998

[51] Int. Cl.[7] ..... E04F 11/16

[52] U.S. Cl. ..... 52/179; 52/741.2

[58] Field of Search ..... 52/177, 179, 181, 52/184, 189, 190, 741.2

[56] References Cited

U.S. PATENT DOCUMENTS

| | | | |
|---|---|---|---|
| 800,895 | 10/1905 | Beevers | 52/181 |
| 943,418 | 12/1909 | Kanski | 52/181 |
| 1,681,073 | 8/1928 | Welcome . | |
| 3,421,274 | 1/1969 | Balzer et al. . | |
| 3,759,000 | 9/1973 | Balzer et al. . | |
| 4,001,991 | 1/1977 | Balzer et al. . | |
| 4,037,374 | 7/1977 | Balzer et al. | 52/179 |
| 4,112,641 | 9/1978 | Balzer . | |

FOREIGN PATENT DOCUMENTS

| | | | |
|---|---|---|---|
| 761150 | 6/1967 | Canada . | |
| 709700 | 8/1931 | France | 52/179 |

OTHER PUBLICATIONS

Wooster Products, Inc., "Anti–Slip Safety Stair and Walkway Products by 'Wooster'", 16 page brochure, Jan. 1995.

*Primary Examiner*—Laura A. Callo
*Attorney, Agent, or Firm*—James A. Lucas; Driggs, Lucas, Brubaker & Hogg Co., L.P.A.

[57] ABSTRACT

A three piece stair nosing is used in new construction and the reconstruction and repair of stairs, primarily for industrial and commercial applications. The stair nosing comprises a metal sub-channel, a front channel including a tread surface, and a rear channel. The sub-channel includes one or more anchors to be embedded in uncured concrete which, when hardened, secures the sub-channel to the stair pan. The front channel includes a metal base and a tread bonded to the base to provide a skid resistant surface. The front channel is locked into place on top of the sub-channel with locking tabs and is secured to the sub-channel with fasteners after which the rear channel is press fit into place to complete the assembly.

13 Claims, 2 Drawing Sheets

THREE-PIECE STAIR NOSING

BACKGROUND OF THE INVENTION

This invention relates to a stair nosing useful in the construction of stairs which are capable of withstanding high traffic volume, which resist loosening, and which can be readily replaced when necessary. The stair nosing forms the front portion of each stair tread.

The construction of concrete stairways is a well-established practice, being used in the erection of commercial and industrial buildings, parking garages, stadiums, swimming pools, and many other types of structures. Each step of a stair comprises a horizontal tread or stair base and a vertical riser.

SUMMARY OF THE INVENTION

It is an object of the present invention to provide a stair nosing of relatively simple structure as described in one or more of the appended claims;

Another object of the present invention is to provide a stair nosing structure having interlocking members for ease of assembly and disassembly;

Yet another object is to provide a stair nosing structure which is rugged and long wearing but which can be easily disassembled for repair or replacement.

These and other objects are achieved in a manner to be hereinafter described by providing a stair tread having a stair nosing structure comprising a sub-channel having a top surface and a bottom surface and including means to secure the sub-channel to a stair base. The front end of the sub-channel forms the leading edge of the structure and an upwardly extending flange comprises the rear edge of the structure. A front channel engages the top surface of the sub-channel when the front channel is slid toward the leading-edge of the sub-channel. The front channel includes means for interlocking with the sub-channel to prevent vertical separation of the front channel from the sub-channel. The front channel has a tread portion forming the tread surface of the stair nosing structure and has a forward and a trailing edge with an upwardly extending flange defining the trailing edge. A rear channel includes a heel surface co-planar with the tread surface of the front channel. The rear channel is press fit into a space between the flange of the front channel and the sub-channel flange. The nosing structure includes means for securing the front channel to the sub-channel when interlocked. This securing means comprises at least one threaded fastener. The sub-channel preferably includes at least two spaced-apart anchors extending downwardly from the bottom surface of the sub-channel along the width thereof. The anchors are adapted to secure the sub-channel to the concrete base. One of the anchors, preferably the one located near the rear of the sub-channel, contains a slot to receive one or more threaded fasteners for removably securing the front channel to the sub-channel. The front channel includes a base with a rearward extension. This extension includes one or more holes through which one or more threaded fasteners removably secure the front channel to the sub-channel. The front channel includes an extruded metal base having a bottom surface with at least one slot extending the width of the channel. The slot includes a groove including a projection extending forward from the groove, adapted to engage a corresponding groove and rearwardly extending projection in the sub-channel. The projection engages the groove when the front channel is slid toward the front end of the sub-channel. The threaded fastener comprises at least one and preferably a plurality of self-tapping screws engaging corresponding holes arranged along of the rearward extension of the front channel for securing the front channel to the sub-channel. The screws are aligned with the slot in the anchor of the sub-channel when the front channel is interlocked with the sub-channel.

The invention further comprises a concrete stair step composed of a stair base and a riser, the step including the stair nosing structure having a tread surface, and a nosing structure mounted on the stair step adjacent to the forward face thereof. The stair nosing structure comprises the sub-channel having a top surface and a bottom surface, a front channel slidably engaging the top surface of the sub-channel, means for securing the front channel to the sub-channel, and a rear channel. The sub-channel includes a front edge forming the leading edge of the stair nosing structure, an upwardly extending flange comprising the rear edge of the sub-channel and means to secure the sub-channel to the concrete stair base. The front channel includes means for interlocking with the sub-channel when the front channel is slid toward the leading edge of the sub-channel. The front channel includes a top surface forming the tread surface of the stair nosing structure. The front channel also has a forward edge, and a trailing edge defined by an upwardly extending flange. The rear channel includes a heel surface co-planner with the tread surface of the front channel, the rear channel adapted to be press fitted into the space between the flange of the front channel and the flange of the sub-channel. The means for securing the front channel to the sub-channel preferably comprises at least one, and typically a plurality of threaded fasteners. At least one and preferably a pair of spaced apart anchors extend downwardly from the bottom surface of the sub-channel along the width thereof. One anchor is located near the rear of the sub-channel and contains a slot to receive the threaded fastener or fasteners. The front channel includes a base with a rearwardly projecting extension. The extension includes one or more holes through which the threaded fasteners removably secure the front channel to the sub-channel. The base of the front channel has a bottom surface containing one or more slots extending the width of the channel. Each slot includes a groove and a projection extending forward from the groove, engaging a corresponding groove and rearwardly extending projection in the sub-channel when the front channel is slid toward a front end of the sub-channel.

In yet another embodiment of the invention, a method is described for assembling a stair nosing structure onto a concrete stair pan. The method includes the steps of a positioning an extruded sub-channel on an uncured concrete mix forming a concrete stair pan. The sub-channel has a leading edge and a rear flange extending upwardly therefrom, and includes anchor means embedded in the concrete mix allowing the concrete mix when cured to secure the anchor means of the sub-channel in the concrete. The front channel has a top surface, and a bottom surface in contact with the top of the sub-channel and interlocked with the sub-channel to prevent the front channel for being vertically separated from the sub-channel. The top surface of the front channel comprises an exposed tread surface. The bottom surface of the front channel is then secured to the sub-channel. A rear channel is press fitted between the flange of the front channel and the rear flange of the sub-channel, The rear channel has a top surface providing a continuation of the tread surface of the front channel. The anchor means preferably comprises a pair of longitudinally extending downwardly projecting anchors, the first anchor located midway between the leading-edge and the rear flange of the sub-channel and the second anchor located near the rear flange. The second anchor contains holes or a continuous slot, wherein fasteners threaded into the slot are used to secure the front channel to the sub-channel. The sub-channel preferably includes a least one undercut groove and a rearwardly extending projection which cooperate with a corresponding forwardly extending projection and an undercut groove on the front channel to interlock the sub-channel with the front channel. The front channel preferably includes an upwardly extending flange defining the rear of the anti-slip tread and an extension of the bottom surface projecting rearwardly through which the fasteners extend. The flange and extension cooperate with the sub-channel flange to form a slot whereupon the rear channel is press fitted into the slot and covers the fasteners.

DETAILED DESCRIPTION OF THE INVENTION

Figure 1:
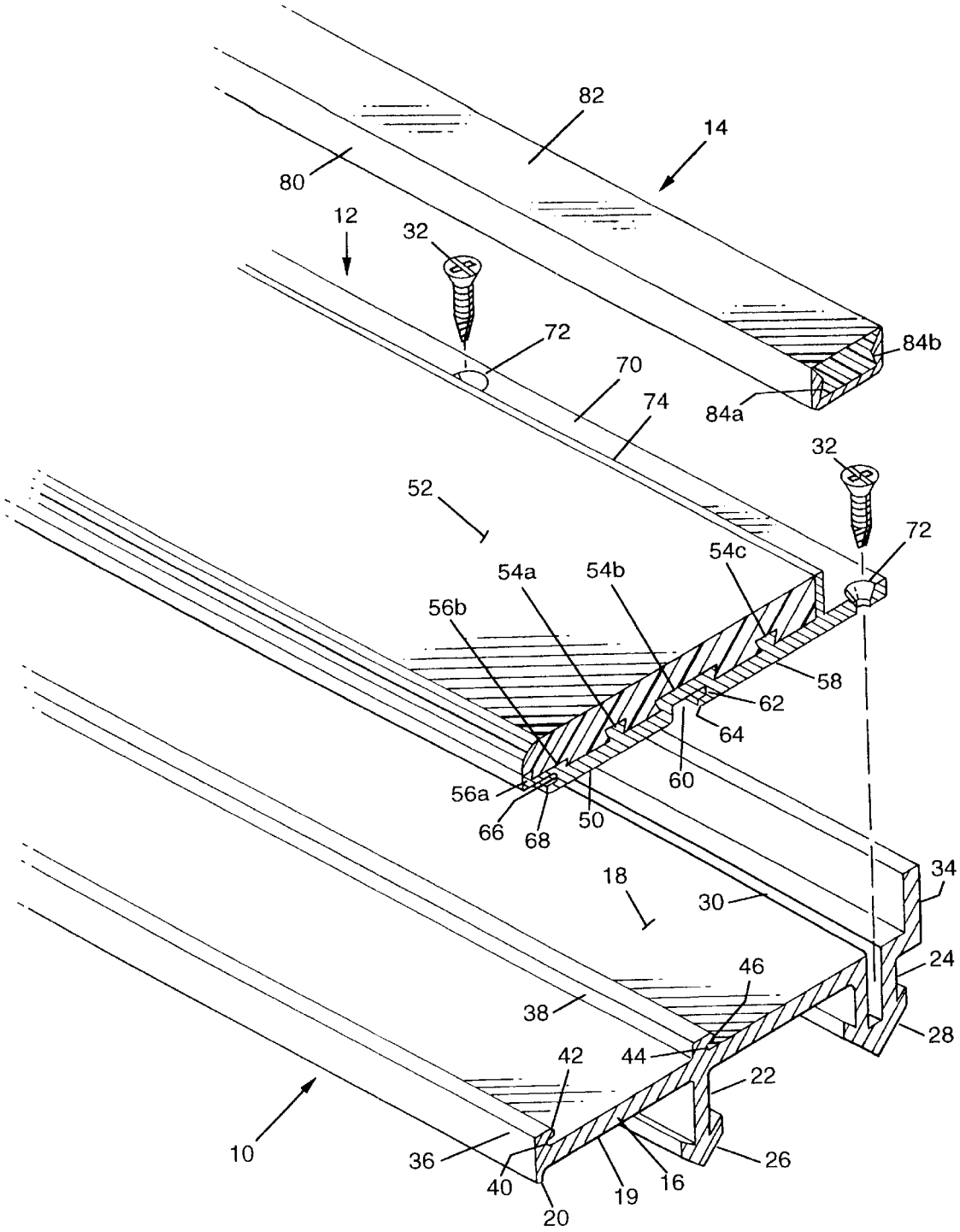
FIG. 1 is an exploded perspective view of the nosing structure of the present invention.

Referring in greater detail to the drawings, FIG. 1 shows the three components of the stair nosing comprising a sub-channel 10, a front channel 12, and a rear channel 14. The sub- channel 10 includes a base 16 having a top surface 18 and a bottom surface 19, a front lip 20 which is adapted to fit over the leading-edge of a concrete pan, a front anchor 22 and a rear anchor 24. These anchors extend down at right angles to the base 16 of the sub-channel and are dart-type anchors adapted to be embedded in poured concrete. The anchors include two wings, 26, 28, extending diagonally toward the base 16 of the sub-channel. The rear anchor 24 includes a slot 30 to receive one or more fastening screws 32.

The rear of the sub-channel comprises an upwardly extending flange 34 terminating flush with the surface of the tread. The sub-channel includes a first upwardly extending locking tab 36 which cooperates with the lip 20 to form the front edge of the sub-channel, and a second locking tab 38 between the front tab 36 and the rear flange 34. The trailing edge of the front tab 36 comprises an undercut groove 40 including a rearwardly extending projection 42. Likewise, the second tab 38 includes an undercut groove 44 beneath a rearwardly extending projection 46.

The front channel 12 comprises an extruded metal base 50 having a bottom surface 58 in contact with the top surface 18 of the sub-channel, and a tread portion 52 molded or otherwise formed from a suitable elastomeric or polymeric tread material containing aluminum oxide, silicon carbide or other particulate abrasive to provide a slip-resistant surface. The tread material is bonded to the metal base by techniques well known in the art such as vulcanizing and/or adhesively bonding. The top surface of the tread material forms the tread surface 53. Dovetail ribs 54*a*, 54*b*, and 54*c* and cutback ribs 56*a* and 56*b* help to anchor the tread portion 52 to the metal base 50. The underside of the dovetail rib 54*b* comprises a slot 60 including an undercut groove 62 and a projection 64 which engage, respectively, the projection 46 and the groove 44 of the intermediate locking tab 38 on the metal base 16 of the sub channel 10. Likewise, the front edge of the front channel base 50 includes a groove 66 and projection 68 which engage, respectively, the front projection 42 and front groove 40 of the front locking tab 36 of the sub-channel 10. The metal base 50 of the front channel 12 terminates in an extension 70 projecting rearwardly from upwardly extending flange 74. The extension includes a plurality of countersunk screw holes 72 spaced at fixed, pre-determined intervals therealong to receive the flat-head self-tapping screws 32 which thread into the slot 30 in the rear anchor 24 to fasten the front channel 12 to the sub-channel 10.

The tread assembly is completed by press fitting the rear channel 14 into the space 4 formed between the sub-channel flange 34 and the front channel flange 74. The rear channel comprises an elongated metal extrusion 80 and an elastomeric or polymeric heel 82 bonded thereto. The composition of the material used for the heel may be the same as, or different than the composition used for the tread portion of the front channel. It may, but is not required to include a particulate material embedded therein. The extrusion typically has a cross-section which includes sides 84*a*, 84*b* which converge toward one another to mechanically anchor the composition, and then diverge to give a wide heel footprint at the tread surface.

Figure 2:
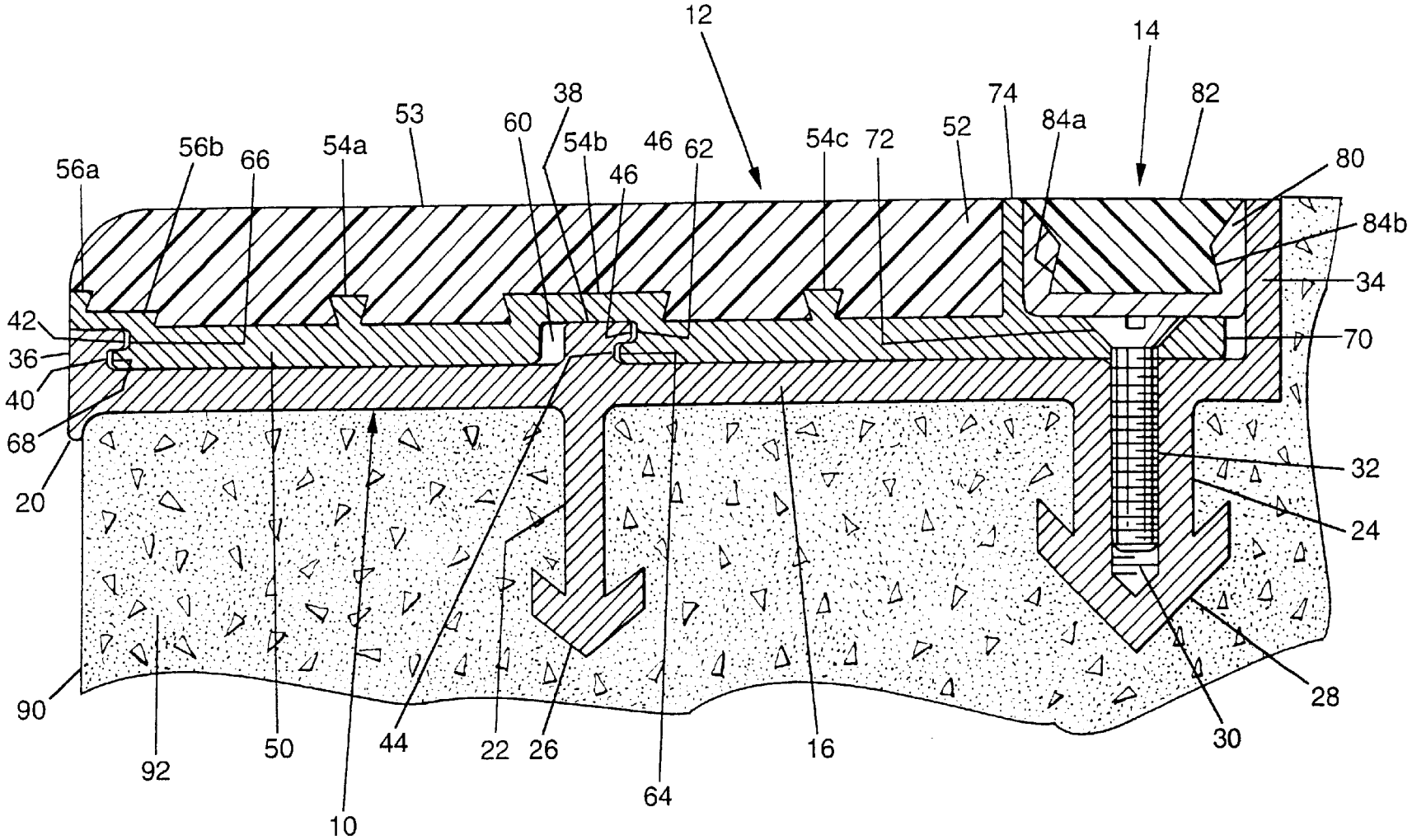
FIG. 2 is a cross-sectional view of the tread assembled on a concrete stair pan.

Referring now to FIG. 2, there is shown a stair pan with the stair nosing secured thereto. The stair pan 90 is made of concrete 92 comprising a hardened aggregate of Portland cement, sand and crushed stone present in the aggregate in ratios which are well known in the art. On top of the stair pan is the three piece stair nosing which is described in the drawing using the same numerals as in FIG. 1. The stair nosing comprises a sub-channel 10, a front channel 12 and a rear channel 14. The sub-channel 10 includes two anchors 22 and 24 extending into the concrete, The anchors have darts 26 and 28 projecting diagonally from the anchors toward the sub-channel to resist removal of the anchors 22 and 24 from the concrete 92. The sub-channel includes locking tabs 36, 38 and an upwardly extending flange 34 which forms the back of the nosing structure. The front channel 12 comprises a tread portion 52 bonded to a metal base, with elongated dovetail ribs 54*a*, 54*b* and 54*c* extending along the base to aid in mechanically securing the tread to the base. The front channel contains first and second grooves 62, 66 and projections 64, 68 which engage corresponding projections 42, 46 and grooves 40, 44 on locking tabs 36, 38. The base 50 of the front channel includes a flange 74 which extends upwards at right angles to the base, terminating flush with the tread surface 52. The base 50 also includes a rearward extension 70 containing a plurality of countersunk holes 72 through which self-tapping screws pass into slot 30 to secure the front channel 12 to the sub-channel 10. Press fitted between the flange 74 of the front channel 12 and the flange 34 of the sub-channel 10 is the rear channel. This comprises a metal extrusion into which is molded a suitable composition 82 as previously described, to form the heel surface of the nosing assembly.

Although the invention has been described with particular reference to specific embodiments, it should be understood that other variations may be used without departing from the basic concept. For example, different materials of construction can be used then those specifically stated herein. Furthermore, various modifications can be made in the design and the inter-engagement of the sub-channel, front channel and rear channel without departing from the scope of this invention. A variety of choices can be used for selecting a fastener for securing the front channel to the sub-channel within the framework of the present invention without departing from the intent thereof. In addition, the slot in the rear channel which receives the fasteners may be replaced with discrete holes extending into the rear anchor to be aligned with corresponding holes in the front channel to receive the fasteners.The invention is intended to embrace all such alternatives, modifications and variations as fall within the spirit and scope of the appended claims.

What is claimed is:

1. A stair nosing structure comprising:

a) a sub-channel having a top surface and a bottom surface, and including:
   i) means to secure the sub-channel to a stair base,
   ii) a front end forming a leading edge of the nosing structure, and
   iii) an upwardly extending flange comprising the rear edge of the nosing structure;

b) a front channel slidably engaging the top surface of the sub-channel including means for interlocking with the sub-channel to prevent vertical separation of the front channel from the sub-channel, and means comprising at least one threaded fastener for securing the front channel to the sub-channel when interlocked therewith, the front channel having a tread portion forming the tread surface of the stair nosing structure, and having a forward edge and a trailing edge, and an upwardly extending flange defining the trailing edge; and c) a rear channel including a heel surface coplanar with the tread surface of the front channel, the rear channel press fit into the space between the front channel flange and the sub-channel flange.

2. The stair nosing structure according to claim 1 wherein the front channel includes a base with a rearward extension, which extension includes at least one hole through which the at least one threaded fastener removably secures the front channel to the sub-channel.

3. The stair nosing structure according to claim 1 wherein the subchannel includes a rearward extension, the at least one threaded fastener comprises a screw engaging a corresponding hole in the rearward extension of the base of the sub-channel for securing the front channel to the sub-channel.

4. The stair nosing structure according to claim 1 wherein the sub-channel includes at least two spaced-apart anchors extending downwardly from the bottom surface of the sub-channel along the width thereof, said anchors adapted to secure the sub-channel to a stair base, wherein one said anchor is located near the rear edge of the sub-channel and contains a slot therein to receive the at least one fastener for removably securing the front channel to the sub-channel.

5. The stair nosing structure according to claim 1 wherein the front channel further includes an extruded metal base having a bottom surface, at least one slot in the bottom surface and a groove including a projection extending forwardly from the groove, and the sub-channel containing a corresponding groove including a rearwardly extending projection, the projection on the sub-channel engaging the groove on the front channel and the projection on the front channel engaging the groove on the sub-channel when the front channel is positioned at the front end of the sub-channel.

6. A concrete stair step comprising a stair base and a riser, the stair step including a stair nosing structure having a tread surface mounted on the stair base adjacent to the forward face thereof, the stair nosing structure comprising:

a) a sub-channel having a top surface and a bottom surface, and including a front end forming the leading edge of the nosing structure and a rear edge; an upwardly extending flange comprising the rear edge, and means to secure the sub-channel to the concrete stair base, said means comprising at least two spaced-apart anchors extending downwardly from the bottom surface of the sub-channel along the width thereof, one anchor being located near the rear of the sub-channel and containing a slot therein b) a front channel slidably engaging the top surface of the sub-channel and including means for interlocking with the sub-channel to prevent separation of the front channel from the sub-channel, the front channel having a top surface forming the tread surface of the stair nosing structure, and having a forward edge and a trailing edge, and an upwardly extending flange defining the trailing edge;

c) means for securing the front channel to the sub-channel when interlocked therewith, said means comprising at least one threaded fastener engaging the slot in the one anchor located near the rear of the sub-channel, and d) a rear channel including a heel surface coplanar with the tread surface of the front channel, the real channel press fit into the space between the front channel flange and the sub-channel flange.

7. The stair nosing structure according to claim 6 wherein the front channel includes a base with a rearward extension, which extension includes at least one hole and the threaded fastener extends through said at least one hole to secure the front channel to the sub-channel.

8. The stair nosing structure according to claim 6 wherein the front channel further includes an extruded metal base having a bottom surface, at least one slot in the bottom surface and a groove including a projection extending forwardly from the groove; and the sub-channel contains a groove including a rearwardly extending projection, the rearwardly extending projection on the sub-channel groove engaging the groove on the front channel and the forwardly extending projection on the front channel groove engaging the groove on the sub-channel when the front channel is positioned at the front end of the sub-channel.

9. The stair nosing structure according to claim 6 wherein the base of the front channel includes a rearward extension including a plurality of holes therealong, and the means for removably securing the front channel to the sub-channel comprises a plurality of screws engaging the corresponding holes in the extension.

10. The stair nosing structure according to claim 9 wherein the holes in the rearward extension of the base of the front channel are aligned with the slot in the anchor when the front channel is interlocked with the sub-channel.

11. A method of assembling a stair nosing structure on to a concrete stair pan comprising:

a) positioning an extruded sub-channel on to an uncured concrete mix forming a concrete stair pan, the sub-channel having a leading edge and a rear flange extending upwardly therefrom, and including anchor means extending into the concrete mix, the anchor means comprising a pair of longitudinally extending downwardly projecting anchors, the first anchor located midway between the leading edge and the rear flange of the sub-channel and the second anchor located near the rear flange and having a slot, b) curing the concrete mix to secure the anchor means of the sub-channel in the concrete;

c) placing a front channel having a top surface and a bottom surface on top of the sub-channel;

d) interlocking at least one portion of the front channel with the sub-channel to prevent the front channel from being vertically separated from the sub-channel, the top surface of the front channel comprising an exposed tread surface;

e) securing the front channel to the sub-channel by threading one or more fasteners into the slot f) press fitting a rear channel between the front channel and the rear flange of the sub-channel, the rear channel having a top surface providing a continuation of the tread surface of the front channel.

12. The method according to claim 11 wherein the front channel is interlocked with the sub-channel by at least one undercut groove and a rearwardly extending projection on the sub-channel cooperating with at least one forwardly extending projection and an undercut groove on the front channel.

13. The method according to claim 11 wherein a slot is defined by an upwardly extending flange defining the rear of the exposed tread of the front channel, and an extension of the bottom surface projecting rearwardly through which the fasteners extends, and the rear flange of the sub-channel whereupon the rear channel is press fit into the slot to cover the fasteners.

* * * * *